US007891718B2

(12) United States Patent
Heinaman

(10) Patent No.: US 7,891,718 B2
(45) Date of Patent: Feb. 22, 2011

(54) DEVICE FOR LIFTING AND MOVING WINDOW FRAMES

(75) Inventor: Mark Heinaman, Henderson, NV (US)

(73) Assignee: Heinaman Contract Glazing, Inc., Las Vegas, NV (US)

( * ) Notice: Subject to any disclaimer, the term of this patent is extended or adjusted under 35 U.S.C. 154(b) by 537 days.

(21) Appl. No.: 11/904,904

(22) Filed: Sep. 28, 2007

(65) Prior Publication Data

US 2009/0084747 A1 Apr. 2, 2009

(51) Int. Cl.
*B66C 1/14* (2006.01)

(52) U.S. Cl. ..... 294/81.3; 294/81.56; 294/67.5; 414/469

(58) Field of Classification Search ..... 294/67.1, 294/67.3, 67.5, 81.3, 81.4, 81.55, 81.56; 414/469, 482, 483, 779, 782, 776
See application file for complete search history.

(56) References Cited

U.S. PATENT DOCUMENTS 1,649,904 A * 11/1927 Longgood ..... 294/81.3
1,840,972 A 12/1932 Raymond
3,406,845 A * 10/1968 Fahey ..... 414/277
3,596,968 A 8/1971 Holm
3,826,112 A * 7/1974 Sick ..... 68/8
3,879,703 A 4/1975 Bonazoli
4,030,751 A * 6/1977 Bobka ..... 298/1 A
4,422,683 A * 12/1983 Charonnat ..... 294/81.3
4,626,012 A * 12/1986 Weldele ..... 294/81.3
4,648,647 A 3/1987 Patton
4,973,094 A * 11/1990 Tana et al. ..... 294/81.21
6,048,012 A * 4/2000 Selby et al. ..... 294/81.3
6,053,550 A 4/2000 Paterson
6,431,791 B2 8/2002 Galluccio
6,474,256 B1 11/2002 Vogel

FOREIGN PATENT DOCUMENTS

EP 763497 3/1997

OTHER PUBLICATIONS

Iris D. Tommelein and Greg Beeche; "De-Coupling Cladding Installation From Other High-Rise Building Trades: A Case Study"; 2001; pp. 1-11.
Construction Innovation Forum—2001 Nova Award Nomination 27; "Exterior Cladding Installation-Beeche Exterior Cladding Installation System for High-Rise Buildings"; 2001; 2 Pages.

* cited by examiner

*Primary Examiner*—Dean J Kramer
(74) *Attorney, Agent, or Firm*—Stetina Brunda Garred & Brucker

(57) ABSTRACT

Provided as a hoist system for installing a plurality of panels of a panel set onto a building structure at a jobsite. The hoist system comprises a beam assembly configured to hoist the panels and sequentially offload the panels from the beam assembly onto the building structure. The beam assembly comprises an elongate hoist beam, a lifting lug, a plurality of trolleys mounted on one of the opposing ends of hoist beam, and a drive mechanism operative to reposition the lifting lug along the hoist beam such that the hoist beams maintain a substantially horizontal or level orientation.

10 Claims, 6 Drawing Sheets

DEVICE FOR LIFTING AND MOVING WINDOW FRAMES

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to exterior panels for installation on high-rise buildings and, more particularly, to a uniquely configured beam assembly that is specifically adapted to hoist a plurality of panels into position on a building structure while maintaining a level or horizontal orientation of the beam assembly during sequential offloading of each panel.

Many modern building structures such as high rise office buildings are fabricated with a plurality of exterior panels which are fastened to the building structure during the final stages of construction. Such exterior panels may include window panels and/or other types of glazing and architectural panels which, when installation is complete, form an enclosure of the building. The size of the panels can be very large and, in some cases, can span several floors of the building. Due to the large size, such panels are relatively heavy and are therefore difficult to handle and maneuver, especially during windy conditions. In addition, the trend toward increasingly larger-sized exterior panels has necessitated the use of hoisting systems such as cranes having ever-increased lifting capacity in order to hoist the panels up the side of the building structure and maneuver the panel into position at the desired elevation.

As may be appreciated, some of the larger or taller buildings may require the installation of thousands of exterior panels. In conventional construction practices, each of these panels must be hoisted one-at-a-time up from the ground floor to many hundreds of feet into the air to the desired elevation where the panel is to be installed. Once hoisted to the desired elevation, the exterior panels must be maneuvered and positioned into place such that mounting brackets on each panel can be connected or attached to mechanical anchors that are affixed to the concrete slabs which form the floor of each story of the building.

As a result of the great heights or elevations to which each panel must be hoisted and maneuvered into position, the time required to complete the installation of all the exterior panels of a high-rise office building can be excessive. Factoring in labor costs such as the cost of renting a suitable lifting mechanism such as a tower crane, the installation of exterior panels on a high-rise office building can be prohibitively expensive and time consuming.

Included in the prior art are several attempts at reducing the overall costs of installing exterior panels on high-rise office buildings. For example, a document entitled "Beeche Exterior Cladding Installation System for High-Rise Buildings" and published in "Construction Innovation Forum" (2001) discloses a system wherein curtain wall panels are hoisted up to a desired position or elevation on the building structure using a crane such as a roof crane. The panels are hoisted up to a monorail system mounted on the building at elevation in a bottom-to-top installation sequence. The monorail allows the panels to be moved laterally into their final installation position on the building. The monorail system is secured to an exterior of the building perimeter. The curtain wall panels are suspended from a trolley suspender which allows for vertical final adjustment and positioning of the exterior panels for attachment to the building structure.

Although the exterior cladding installation system disclosed in the Beeche reference represents an improvement in reducing the overall time required to install exterior panels on a building structure, the same system presents certain drawbacks and deficiencies which detract from its overall utility. For example, the Beeche cladding installation system requires a variety of specialty fixtures and equipment which must be custom designed and manufactured in order to fit the specific size and configuration of the building structure to which it is to be mounted. For example, the Beeche system discloses the use of a space frame that must be erected and positioned at ground level adjacent the building structure so that panel sets may be offloaded from vehicle delivery systems such as a flat bed trailer.

The panels are suspended under the space frame while awaiting hoisting up to the desired elevation. The need for such specialized equipment such as the space frame reduces the overall cost-effectiveness of the Beeche installation system. Furthermore, the space frame occupies an area adjacent the building structure which presents an impediment to normal construction operations. Even further, the space frame presents a potential safety hazard to construction workers due to the large and heavy panels sets which are suspended at a height above the ground that allows workers to pass underneath.

A further disadvantage or drawback associated with the Beeche system is related to the specialty monorail which must be specifically designed, fabricated and installed on the building structure so that the panel sets may be suspended at the desired elevation once they are hoisted. As was mentioned above, the monorail system allows the panels to be moved laterally into their final installation position on the building. Furthermore, during the bottom-to-top installation sequence of the exterior panels, the monorail must be periodically disassembled and/or removed from the building structure for reassembly at the next higher elevation position so that the next set of exterior panels may be installed.

As can be seen, there exists a need in the art for a hoist system that is adapted for installing a plurality of exterior panels onto a building structure in a reduced amount of time and with reduced cost. Furthermore, there exists a need in the art for a hoist system for installing a plurality of panels onto a building structure which does not occupy work space around the exterior of the building at the ground floor. In addition, there exists a need in the art for a hoist system for installing a plurality of panels onto a building structure which reduces the risk of harm associated with relatively large exterior panels suspended near ground level. Finally, there exists a need in the art for a hoist system for installing a plurality of panels onto a building structure which is of simple construction, which is simple to use and which prevents scheduling conflicts with the many other types of construction activities that are typically associated with building construction.

BRIEF SUMMARY

The above mentioned drawbacks and deficiencies associated with prior art hoist systems is alleviated by the present invention which provides a hoist system for installing a plurality of panels onto a building structure at a jobsite. The building structure may comprise any structure including conventional office buildings, roadways, sculptures, formations, monuments, bridges and any other application wherein a plurality of objects must be hoisted and maneuvered into position for final installation.

In its broadest sense, the hoist system comprises a beam assembly which includes an elongate hoist beam, a lifting lug coupled to the hoist beam, a plurality of trolleys mounted at one end of the hoist beam, and a drive mechanism which is operative to manually or automatically reposition the lifting lug along the hoist beam such that the hoist beam is maintained in a substantially horizontal or level orientation. The hoist system may further include a lifting mechanism such as a tower crane or a materials crane which is configured to be coupled to the lifting lug and is adapted to hoist and laterally position the beam assembly at a desired elevation or position on the structure.

Delivery of the panels to the jobsite may be provided by a panel delivery vehicle such as a conventional flatbed tractor trailer which is configured for transporting at least one panel set from the panel fabricator to the jobsite. Each of the panel sets comprises a plurality of panels which are preferably mounted on a pallet to provide rigidity for transporting the panel set. Once at the jobsite, a panel mover such as a forklift may be employed to move the panel set from the panel delivery vehicle (i.e., flatbed tractor trailer) to a riser fixture which is specifically adapted for reorienting the panel set from a shipping orientation (i.e., on the flatbed tractor trailer) into a hoisting orientation. In this regard, the riser fixture is configured to pivot vertically upwardly in order to orient the panels from a horizontal orientation into a near-vertical orientation.

The beam assembly may further include a leveling mechanism which is operative to sense the orientation of the hoist beam and cause the drive mechanism to reposition the lifting lug along the length of the hoist beam to maintain the horizontal orientation thereof. The drive mechanism itself may comprise an electric motor coupled to a screw drive which, in turn, may be threadably engaged to a threaded collar which is engaged to the lifting lug. In this manner, the electric motor is operative to rotatably drive the screw drive in response to input or signals received from the leveling mechanism.

The electric motor itself may be powered by at least one battery which, in turn, may be charged continuously by a battery charger. The hoist beam may further include a generator which is mounted thereupon and which is adapted to provide power to the battery charger for charging the batteries. An inverter may be included with the generator in order to convert voltage produced thereby from 110V volts to 24V, or vice versa, depending upon configuration of the batteries.

The drive mechanism is configured to be manually activatable such as by means of a remote control which is in wireless communication with a receiver that may be mounted on the hoist beam. The receiver is operative to receive signals transmitted by the remote controller such as by personnel on the ground for regulating operation of the drive mechanism. In a further embodiment, the drive mechanism may be configured to be autonomously activatable and, in this regard, may include a leveling mechanism which continuously senses the orientation of the hoist beam and causes the drive mechanism to reposition the lifting lug to maintain the horizontal orientation of the beam assembly. The leveling mechanism may compromise at least one sensor for sensing the orientation of the hoist beam. The sensor may comprise a pair of micro-switches which may be configured in a manner similar to Mercury (Hg) switches commonly utilized in residential thermostats.

BRIEF DESCRIPTION OF THE DRAWINGS

These and other features of the invention will become more apparent in the following description in which reference is made to the appended drawings and wherein.

DETAILED DESCRIPTION

Figure 1:
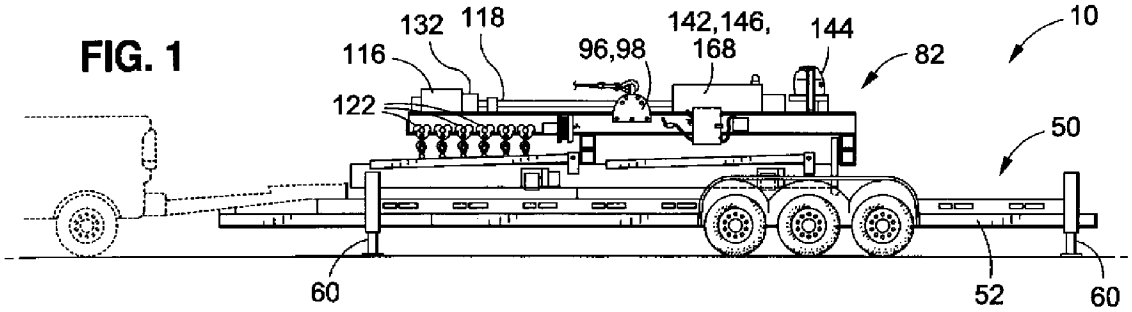
FIG. 1 is a side view of a hoist system including a beam assembly mounted on a riser fixture.

These and other features of the present invention will become more apparent upon reference to the drawings wherein the showings are provided for illustrating preferred embodiments of the present invention and not for purposes of limiting the same, and wherein FIG. 1 illustrates, in one embodiment, a uniquely configured hoist system 10 which is specifically adapted for installing a plurality of panels 24 onto a structure (not shown) such as a building, roadway, sculpture, formation, monument, bridge, or any other application wherein a large number of objects such as exterior or cladding panel 24 must be hoisted to a substantial elevation at a specific work level for subsequent positioning and mounting on the structure.

In its broadest sense, the hoist system 10 comprises a beam assembly 82 which is configured to hoist a plurality of panels 24 such as by means of a lifting mechanism 72 (e.g., tower crane) and wherein the plurality of panels 24 are sequentially offloaded while the lifting lug 96 is repositioned along the hoist beam 84 such that the hoist beam 84 is maintained in a level orientation after offloading of each panel 24. The beam assembly 82 includes an elongate hoist beam 84, a lifting lug 96, a plurality of trolleys 122, and a drive mechanism 114 which is operative to manually or automatically reposition the lifting lug 96.

Figure 2:
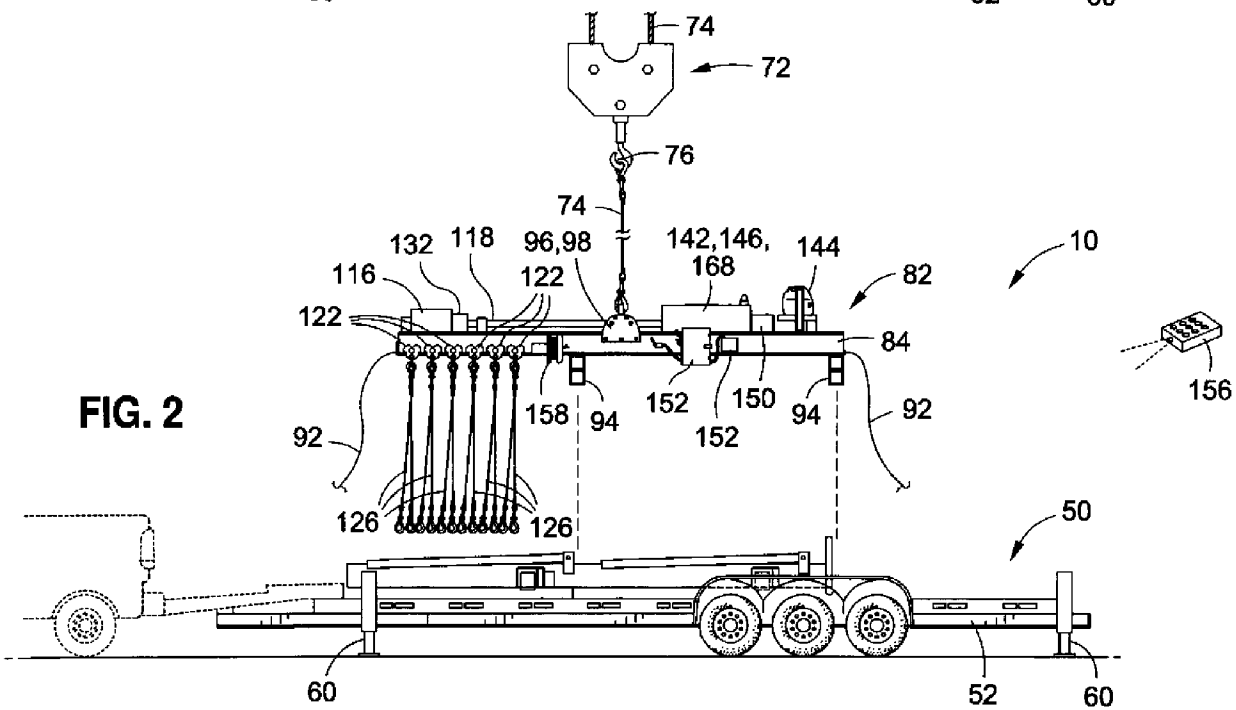
FIG. 2 is a side view of the hoist system illustrating the beam assembly suspended above the riser fixture by a lifting mechanism such as a roof crane or tower crane.

Referring to FIG. 1, the hoist beam 84 is shown mounted on a riser fixture 50 which may be mounted on a trailer 52 for transporting the riser fixture 50 to and from a jobsite. The hoist beam 84 may be configured as an I-beam having upper and lower flanges 86, 88 interconnected by a vertical web 90. The riser fixture 50 may be adapted for transporting the beam assembly 82 by means of a pair of spacer blocks 94 which are shown in FIG. 2 as being mounted along the beam length for supporting the hoist beam 84 on the riser fixture 50. The riser fixture 50 is specifically adapted for reorienting the panel set 22 from a shipping orientation into a hoisting orientation in a manner that will be described in greater detail below. The trailer 52 upon which the riser fixture 50 is mounted may include outriggers 60 at extreme corners of the riser fixture 50 (i.e., trailer 52) for stabilizing the riser fixture 50 during operative use thereof.

Referring still to FIG. 1, the beam assembly 82 is shown temporarily mounted or resting on the riser fixture 50 prior to connection to a lifting mechanism 72 such as a tower crane. In this regard, it should be known that any suitable lifting mechanism 72 for hoisting the hoist beam 84 may be used in the present invention. For example, lifting mechanism 72 may comprise a roof crane, a materials hoist or any other suitable mechanism by which the beam assembly 82 may be hoisted at the lifting lug 96 of the beam assembly 82.

Referring to FIG. 2, shown is the beam assembly 82 suspended by a crane cable 74 extending downwardly from a tower crane and including a hook 76 below which an additional cable may be engaged to the lifting lug 96 of the beam assembly 82. As was earlier mentioned, the lifting lug 96 acts as a fulcrum 98 of the hoist beam 84 and is operatively coupled to the hoist beam 84 configured to be selectively positionable along a length thereof by means of the drive mechanism 114 which may comprise a motor 116 and/or drive or other suitable mechanism for operatively repositioning the lifting lug 96 along the hoist beam 84 such that the hoist beam 84 is maintained at a substantially horizontal or level orientation.

Referring still to FIG. 2, shown fixedly mounted on one of opposing ends of the hoist beam 84 is a plurality (e.g., six) of trolleys 122, each of which is configured to have at least one panel 24 suspended therefrom and which is operative to sequentially offload each panel 24 after hoisting to the desired elevation and positioning on a structure. Preferably, located at an end opposite the trolleys 122, a generator 144 may be mounted for providing power to a battery charger 148 for recharging at least one more batteries 142. The batteries 142 are preferably configured to provide power to the drive mechanism 114. Referring still to FIG. 2, shown mounted adjacent the generator 144 is a control panel 150 and/or battery charger 148 for recharging the batteries 142.

A pair of electrical boxes 152 may also be mounted adjacent the control panel 150 and each of which is configured to house various components related to the power system for the beam assembly 82. For example, one of the electrical boxes 152 is preferably configured to house a receiver 154 which is preferably in wireless communication with one or more remote controls 156. The other one of the electrical boxes 152 may be configured to house a leveling mechanism 128 for sensing the orientation of the hoist beam 84 and causing the drive mechanism 114 to reposition the lifting lug 96 at the appropriate position along the length of the hoist beam 84. In addition, the leveling mechanism 128 itself may comprise any suitable type of sensor 136 for sensing the orientation of the hoist beam 84. For example, the sensor 136 may be configured as a conventional Mercury (Hg) switch having opposing micro-switches 138 for activating the drive mechanism 114 in order to maintain the level orientation of the hoist beam 84.

Referring still to FIG. 2, the drive mechanism 114 itself preferably comprises a screw drive 118 which may be rotatably driven by an electric motor 116. The motor 116 may be powered by the battery 142 or pair of batteries 142 which are preferably mounted adjacent to the generator 144. A reducer 132 may be preferably included in the drive mechanism 114 to reduce the rotational speed of the electric motor 116 in order to provide the requisite torque for driving the drive mechanism 114. As was earlier mentioned, the drive mechanism 114 causes the lifting lug 96 to be repositioned along the hoist beam 84 for maintaining the horizontal orientation thereof. At opposing ends of the screw drive 118, a pair of bearings 134 are preferably installed which are fixedly mounted to the hoist beam 84 for rotatably supporting the drive mechanism 114. The above descriptions of the components of the beam assembly 82 are described in greater detail below with reference to FIG. 8.

Figure 3:
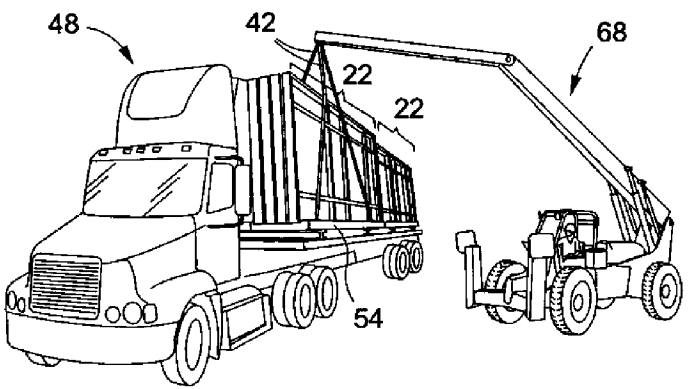
FIG. 3 is a perspective view of a panel delivery vehicle such as a flatbed tractor trailer and wherein a panel mover such as a forklift may be used to lift and move a panel set from the panel delivery vehicle.

FIG. 3 illustrates a panel delivery vehicle 48 which is illustrated as a flatbed tractor trailer that is specifically adapted for transporting the panel sets 22 from an offsite location (e.g., such as a panel fabricator or panel manufacturer) to the jobsite. As can be seen in FIG. 3, each panel set 22 comprises a plurality of panels 24. For example, four panels 24 may be included in one panel set 22 although any number may be used. In addition, each of the panel sets 22 is preferably provided or delivered on a structurally stable platform such as a pallet 54 such as a steel pallet 54 so that the panel set 22 may be hoisted and moved from the panel delivery vehicle 48 over to the riser fixture 50.

Figure 4:
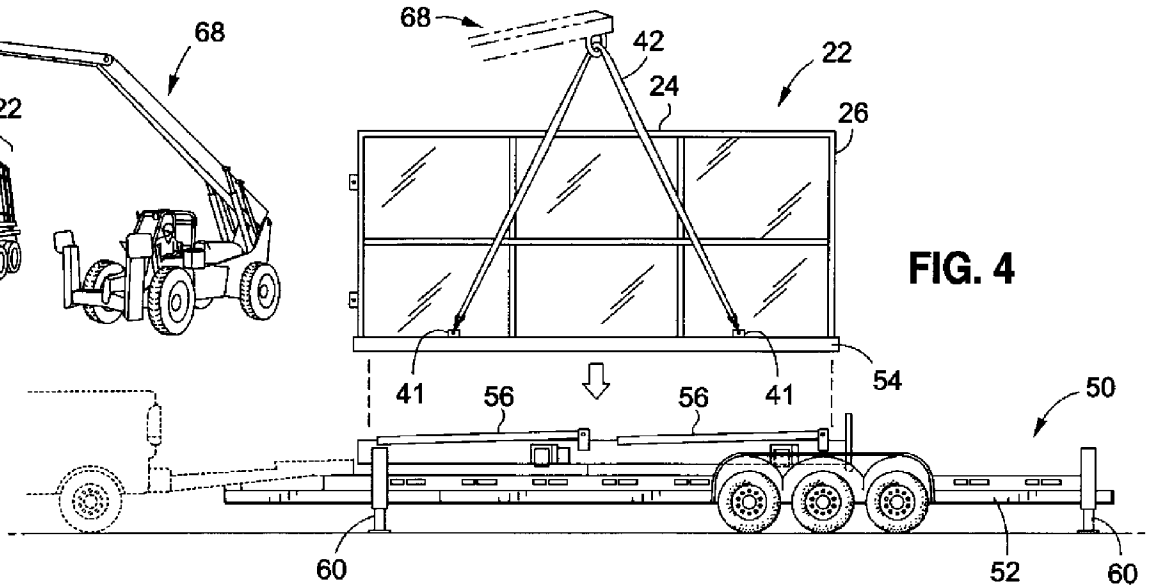
FIG. 4 is a side view of the panel set suspended below the panel mover (i.e., forklift) prior to lowering of the panel set of the riser fixture.

Referring still to FIG. 3, a panel mover 68 such as a forklift may be used in order to lift the panel set 22 off the flatbed trailer such as by means of a harness 42 which is secured to lugs 41 that are included with the pallet 54 as best seen in FIG. 4. In the embodiment shown, the panel 24 is illustrated as a window panel 24 comprising a frame 26 having glazing 34 (i.e., glass or architectural panels) integrated therewithin. Each frame 26 itself may comprise a vertical mullion 28 and a plurality of sills 32 or headers 30 and diagonal braces which collectively form the panel 24.

Referring to FIG. 4, the panel mover 68 (i.e., forklift, shown in phantom) may also be used to position the panel set 22 onto the riser fixture 50 prior to reorientation the panel set 22 into a hoisting position. However, it is also contemplated that the panels 24 (i.e., panel sets 22) may be delivered in the hoisting orientation such that the reorientation by the riser fixture 50 is not necessary. The riser fixture 50 may be provided with pivotable fixture arms 56 which are specifically adapted to be repositioned from a horizontal orientation into a vertical orientation in order to cradle and stabilize each panel set 22 on the riser fixture 50.

Figure 5:
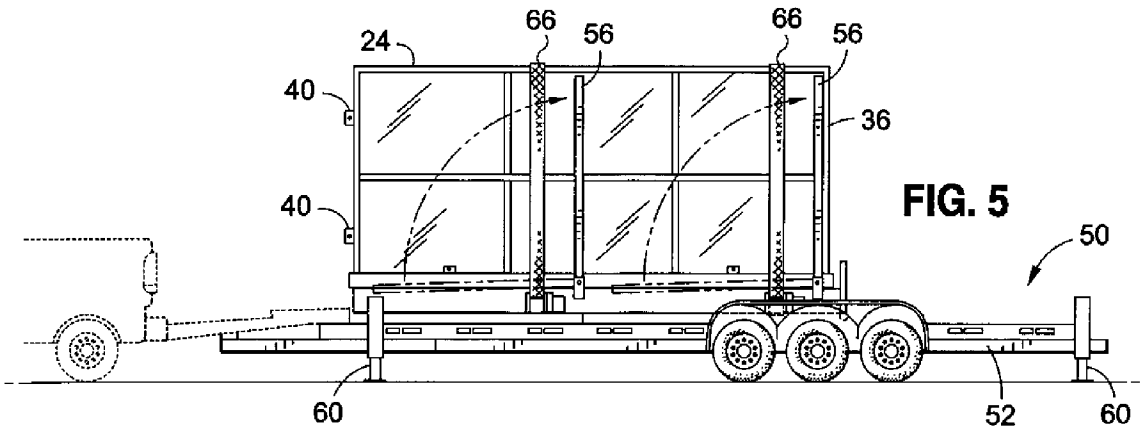
FIG. 5 is a side view of the panel set suspended on the riser fixture in a shipping orientation.

Referring to FIG. 5, prior to reorienting or tilting each panel set 22 from a horizontal or shipping orientation into a hoisting orientation, the panel sets 22 are preferably secured to the riser fixture 50 by means of webbing 66 passing over the top of each panel set 22 on opposed ends thereof. In this manner, each panel set 22 is mounted on a riser fixture 50 along its length in such a manner that movement of the panel set 22 during the tilting operation is prevented.

Figure 6:
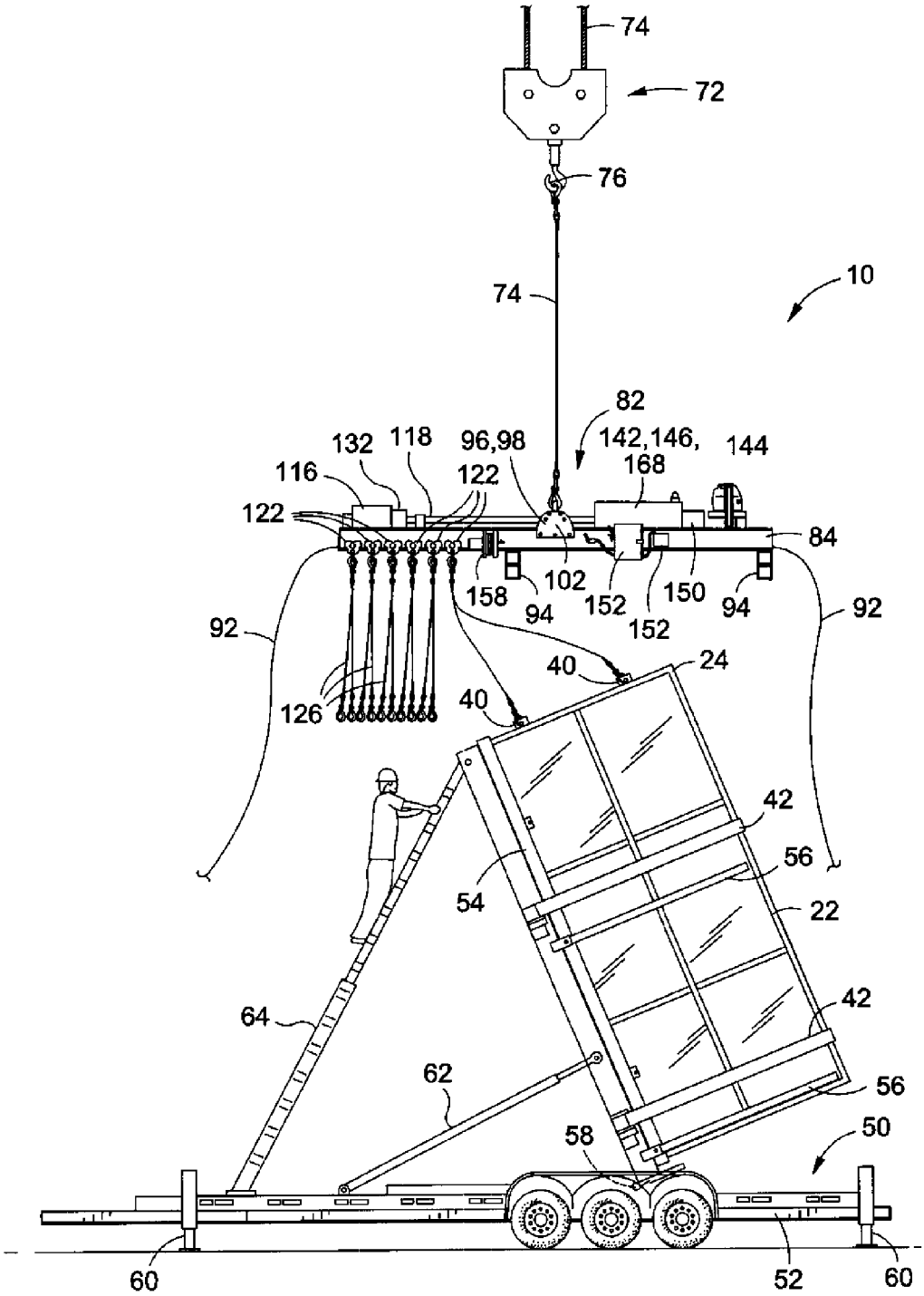
FIG. 6 is a side view of the panel set reoriented from the shipping orientation into a hoisting orientation prior to engagement of the panels of the panel set to the beam assembly which is shown suspended from the lifting mechanism.

Referring to FIG. 6, shown is the panel set 22 reoriented from the shipping orientation into a hoisting orientation by means of rotation thereof about a pivot. A hydraulic or pneumatic cylinder 62 or jack may be utilized to provide the rotational or tilting drive are forced to the visor although any other suitable system may be used in order to reorient the riser fixture 50 from a horizontal orientation or substantially vertical orientation. Preferably, it is desirable to avoid a complete vertical orientation of the panel sets 22 such that a portion of the weight of the panels 24 is back-loaded onto the riser fixture 50. In this manner, the panels 24 are at least partially supported by the riser fixture 50 until hoisted off of the riser fixture 50 by the beam assembly 82.

Figure 7:
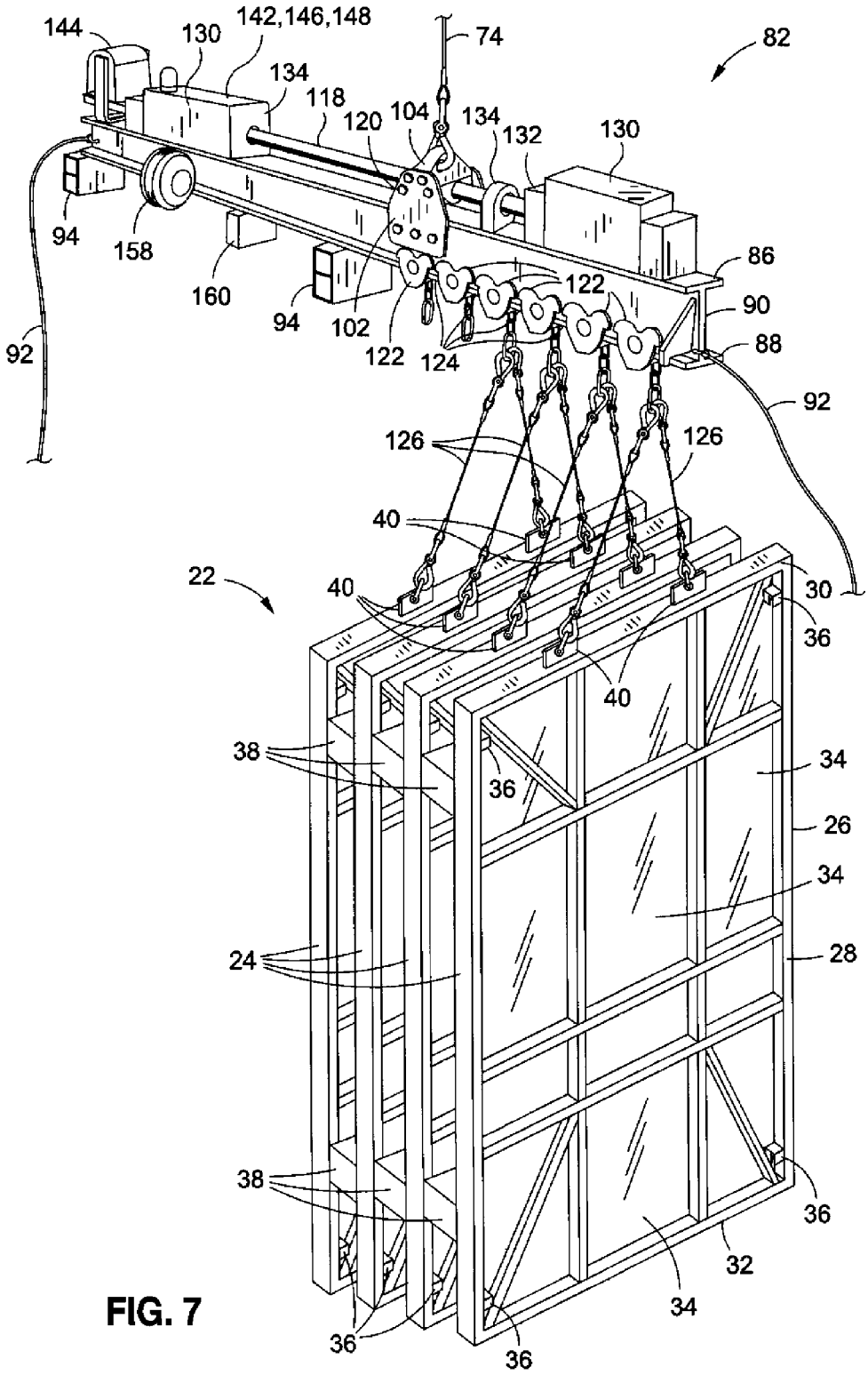
FIG. 7 is a perspective view of the plurality of panels engaged to a corresponding trolley fixedly mounted on one of opposing ends of the beam assembly and further illustrating a lifting lug operatively coupled to the beam assembly and configured to be positionable along the length thereof.

Referring to FIG. 7, shown is the beam assembly 82 having a plurality of panels 24 suspended therefrom prior to offloading of the panels 24 at a desired elevation on a building structure. Each of the panels 24 is separately connected to a corresponding one of the trolleys 122 by at least one cable which extends from the trolley 122 down to a panel lug 40. Preferably, each panel 24 includes a pair of panel lugs 40 mounted on opposing sides of a top portion of the panel 24 in order to prevent or resist swinging motion of the panel 24 such as may occur in high winds while the panel 24 is being hoisted. Each of the panels 24 may include at least one bumper 38 strip mounted on upper and lower ends and spanning a width of the panel 24.

Figure 9:
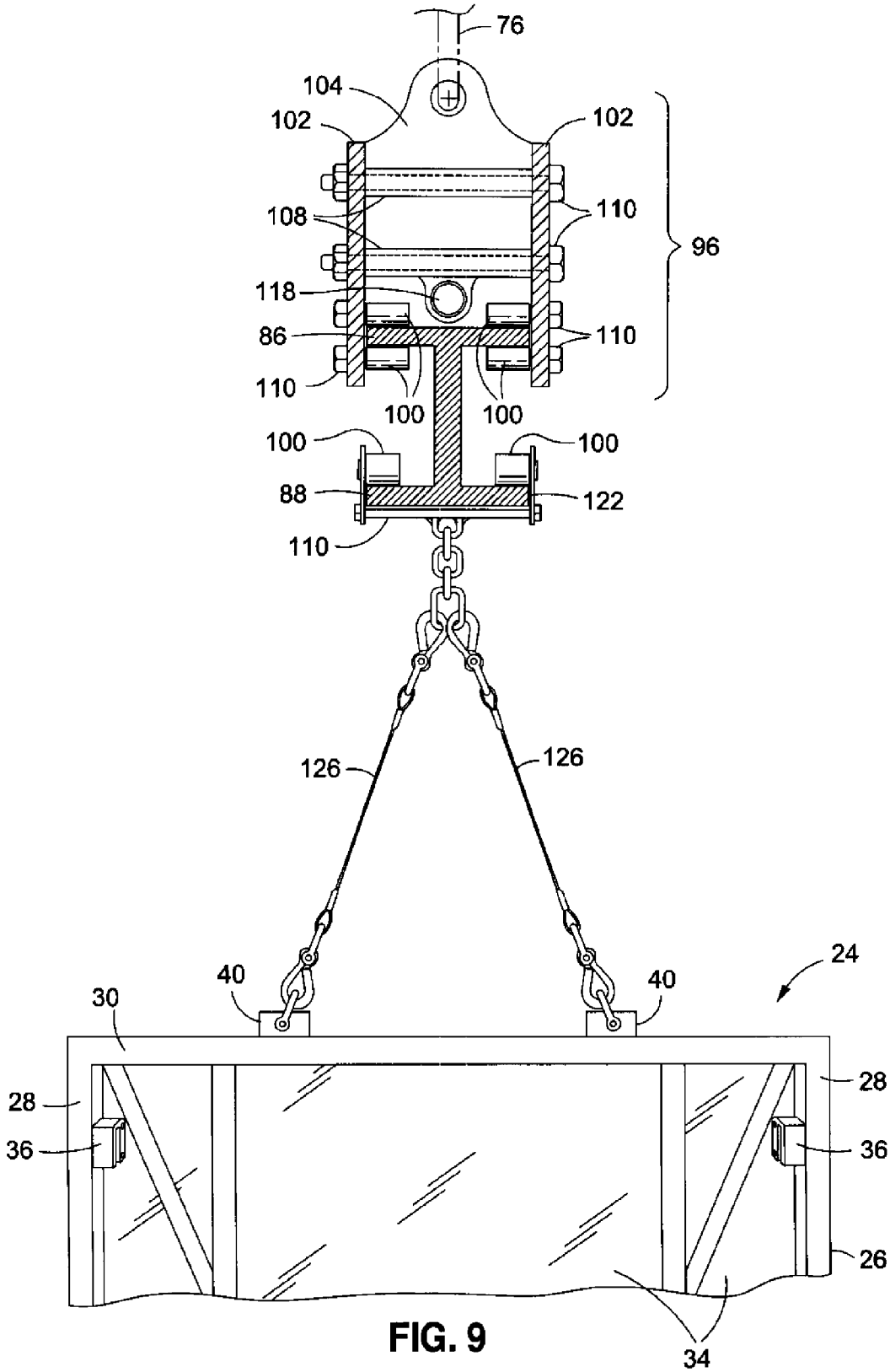
FIG. 9 is a partial sectional view of the beam assembly illustrating the engagement of the trolley to a lower flange and the engagement of the lifting lug to an upper flange of the hoist beam.

The bumper 38 strips prevent contact between the adjacent panels 24 during hoisting and positioning of the panels 24. Each of the bumper 38 strips may comprise a suitable resilient material configured to resist scratching, marking or otherwise damaging adjacent panels 24. For example, each of the bumper 38 strips may simply comprise a length of wooden material or other suitable material spanning a width of the panel 24 at the top and bottom ends thereof. In one embodiment, each bumper 38 strip may be mounted to a mounting bracket 36 which is best seen in FIG. 9 and may be located on opposing sides of the mullions 28 of each panel 24. The mounting bracket 36 is configured to engage a corresponding anchor such as a mechanical anchor which may be embedded, cast or otherwise mounted to one of the floor slabs 16 from which the panel 24 may be fixedly secured in its final resting position.

Figure 8:
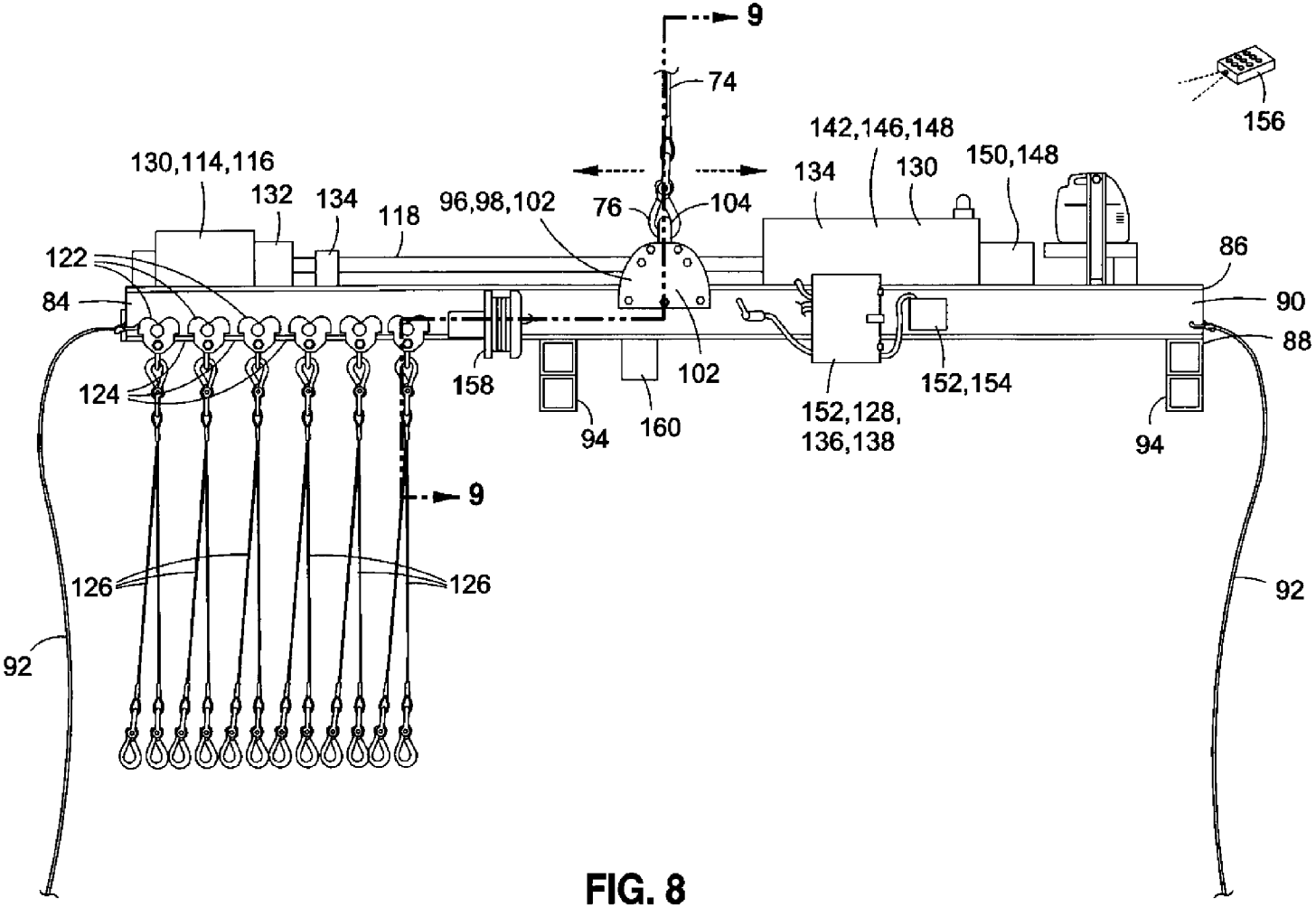
FIG. 8 is a side view of the beam assembly illustrating the trolley being mounted at an end of the beam assembly and further illustrating a drive mechanism for repositioning the lifting lug along the hoist beam such that the hoist beam is maintained in a substantially horizontal orientation.

Referring to FIGS. 7-9, each of the trolleys 122 can be seen as being suspended from a lower flange 88 of the I-beam. In one embodiment, each of the trolleys 122 may include a pair of rollers 100 mounted on opposing sides of the lower flange 88 of the I-beam and from which a pair of plates may extend downwardly therefrom for supporting a hook 76 of the trolley 122. The hook 76 is preferably configured to be connectable to one or more cables such as a pair of cables for supporting each of the panels 24 as can be seen in FIG. 7.

Each of the trolleys 122 is preferably disposed in series along the I-beam towards an extreme end thereof. Installed between each one of the trolleys 122 is preferably a safety latch 124 or safety lug to prevent movement of the trolleys 122 after installation on the hoist beam 84. In addition, the trolleys 122 may include bumpers 38 or stops to cushion contact between the trolleys 122. A preferable embodiment of trolley 122 for installation on the beam assembly 82 of the present invention is that which is commercially available from Jet Equipment and Tools of Canada. More preferably, the trolley 122 configuration is preferably a 1-PT (i.e., Plane Trolley) manufactured by Jet Equipment and Tools. However, any suitable mechanism for supporting the cable may be utilized for supporting the present invention. Although six (6) trolleys 122 with corresponding safety latches 124 are shown installed on the hoist beam 84, any number may be installed.

Referring still to FIGS. 7-9, disposed above the trolleys 122 and mounted on the upper flange 86 of the hoist beam 84 is a drive mechanism 114 which is operative to reposition the lifting lug 96 of the hoist beam 84 along the length of the hoist beam 84 in order to maintain the balance or horizontal orientation of the beam assembly 82 as each panel 24 is offloaded therefrom. In one embodiment, the drive mechanism 114 may comprise a motor 116 which is operatively coupled to a threaded shaft or screw drive 118. The motor 116 may be configured as an electric motor 116 which may be mounted within a housing 130 mounted on an end of the hoist beam 84 above the trolleys 122. As was earlier mentioned, the motor 116 may include a reducer 132 which acts to reduce the rotational speed of the motor 116 and thereby increase the torque of the motor 116 as well as increase the level of adjustability for repositioning the lifting lug 96 along the length of the hoist beam 84. More specifically, in the embodiment wherein the screw drive 118 is configured as a shaft having spirally cut grooves for engaging a threaded tower of the lifting lug 96, then the reducer 132 acts to reduce the number of revolutions produced for a greater number of revolutions of the motor 116.

Referring more particularly, to FIG. 9, the configuration of the lifting lug 96 and, more particularly, to the threaded collar 120 which is preferably fixedly mounted to the lifting lug 96 and upon which the lifting lug 96 is coupled to the screw drive 118. In the embodiment shown in FIG. 9, the lifting lug 96 comprises a pair of vertically disposed plates mounted on opposing sides of the upper flange 86 of the hoist beam 84. Each of the hoist plates 102 may be interconnected by a pair of spacers 108 or other suitable spacing mechanism. As shown in FIG. 9, the lifting lug 96 may include an upper spacer 108 which may be integrally formed with a hoist hook 104 while the lower spacer 108 may be integrally formed with the threaded collar 120.

Mounted to lower portions of each of the hoist plates 102 may be at least two rollers 100 and, more preferably, three rollers 100, that may be engaged to an under side of the upper flange 86 and upon which the lifting lug 96 rolls back and forth along the hoist beam 84. However, it is also contemplated that a corresponding pair of rollers 100 may be disposed on an upper surface of the upper flange 86 to prevent or restrict vertical movement of the lifting lug 96 relative to the hoist beam 84. The mechanical fastener 110 extending through each of the spacers 108 may comprise a simple nut and bolt or a threaded rod and nut combination. The lifting lug 96 may be provided in any suitable configuration such that the lifting mechanism 72 (i.e., tower crane, roof crane, materials hoist, etc.) may be coupled to the beam assembly 82 to allow hoisting and maneuvering of the panels 24 into position on the building structure.

Although the drive mechanism 114 is shown and illustrated as comprising an electric motor 116 rotatably coupled to a screw drive 118 which, in turn, may be engaged to the threaded collar 120 of a lifting lug 96, it is also contemplated that the drive mechanism 114 may be provided in a variety of alternative arrangements including, but not limited to, a chain drive arrangement, a gear track mounted on the upper flange, or any other suitable arrangement which is operative to reposition the lifting lug 96 along the hoist beam 84.

Referring to FIGS. 7-8, the screw drive 118 can be seen extending from the motor 116 mounted on one end of the hoist beam 84 through the lifting lug 96 and journaling into a bearing 134 or other suitable support for the screw drive 118 mounted or contained within a housing 130 mounted on a side of the lifting lug 96 opposite from the trolleys 122. Each of the housings 130 is preferably configured to protect the contents thereof from the elements as well as prevent intrusion of debris, moisture, and other undesirable elements. Optionally includable upon one of the housings 130 may be a light source such as a flashing light in order to provide an indication of the orientation and/or position of the hoist beam 84 in low light conditions.

Referring still to FIGS. 7-8, the beam assembly 82 may optionally include a generator 144 which may be mounted in a suspended manner on the hoist beam 84 and which is configured to provide power to batteries 142 which, in turn, provide power to the electric motor 116. In one embodiment, the electric component may be configured as a thirty (30A) amp motor 116 configured to rotatably drive the screw drive 118. As was mentioned above, the screw drive 118 is configured to cause the lifting lug 96 to move transversely (i.e., along the hoist beam 84 length) under the influence of the electric motor 116. Each end of the screw drive 118 is also preferably mounted in a bearing 134 or a journal.

As can be seen in FIG. 8, the screw drive 118 may be covered by a flexible or semi-flexible housing such as a flexible sewer house. The housing protects the screw drive 118 from dirt and debris which may otherwise interfere with threadable movement of the lifting lug 96 relative to the screw drive 118. In one embodiment, the screw drive 118 is operative to transversely reposition the lifting lug 96 relative to the beam length along approximately eight (8) feet of travel in about eight (8) minutes of time. However, the drive mechanism 114 may be configured to reposition the lifting lug 96 along any amount of travel and during any period of time.

In one embodiment, the generator 144 preferably provides power to a battery charger 148 which, in turn, preferably continuously charges the batteries 142. In a further embodiment, the battery charger 148 may be configured to be switched to an auxiliary mode wherein the battery charger 148 can be used to power other devices. The generator 144 is also preferably configured to be toggled between an emergency setting, a manual setting and an automatic setting. As was earlier mentioned, the generator 144 is preferably suspended such that the generator 144 is maintained in a level orientation regardless of the orientation of the beam assembly 82. In this manner, the internal components of the generator 144 are provided with proper lubrication in the oil bath (i.e., crank case) of the generator 144. In addition, the fuel tank of the generator 144 is maintained in a level orientation for proper fuel feeding of the generator 144 engine. The beam assembly 82 may include an inverter 146 which is configured to convert voltage produced by the generator 144 from 24V to 110V, or vice versa.

The batteries 142 are preferably configured as a pair of gel batteries 142 which are preferably industrial grade, high amperage batteries 142 and are preferably provided as 12V batteries 142. The batteries 142 are preferably connected in series to produce a 24V output. The inverter 146 is preferably housed under the housing 130 adjacent the generator 144 and within which the batteries 142 may also be contained or housed. The battery charger 148 is preferably a 24V device with a no-polarity arrangement which provides the ability to connect either the positive or the negative terminals of each battery 142 to the battery charger 148. The battery charger 148 may include an internal switching mechanism in order to maintain correct polarity or positive polarity connection to the batteries 142 for proper charging.

In one embodiment, the battery charger 148 may be similar to that which is commercially available from Quick Change Corporation of Oklahoma City, Okla. The battery charger 148 may be mounted within a control panel 150 which is disposed between the housing 130 and the generator 144 as best seen in FIG. 8. A pair of electrical boxes 152 may be mounted on a side of the hoist beam 84. In FIG. 8, a larger one of electrical boxes 152 may be configured to house a leveling mechanism 128 which is operative to sense the orientation of the hoist beam 84 and cause the drive mechanism 114 to reposition the lifting lug 96 along the length of the hoist beam 84 for maintaining the hoist beam 84 in a substantially horizontal or level orientation. The leveling mechanism 128 may comprise at least one and, more preferably, a pair of sensors 136 which are adapted to sense the orientation of the hoist beam 84 and transmit signals representative thereof to the drive mechanism 114. The sensor 136 may comprise a pair of micro-switches 138 which are configured in the same manner as a common Mercury switch such as that found in thermostats.

Referring still to FIG. 8, a second or smaller electrical box 152 may be mounted adjacent the larger electrical box 152. The smaller electrical box 152 may be adapted for containing a receiver 154 to enable operation of the beam assembly 82 by remote control 156. In one embodiment, the remote control 156 may be configured similar to that which is commercially available from REMTRON Wireless Control Systems. The remote control 156 (i.e., transmitter) is operative to communicate with the receiver 154 such that the receiver 154 receives signals from the remote control 156 using any suitable transmission technology. In one embodiment, the remote control 156/receiver 154 may operate using 900 MHz technology however, communication between the remote control 156 and the receiver 154 may use other medians including infrared, radio frequency (RF), short wave, or any other suitable wireless communication medium. Preferably the receiver 154 and the remote control 156 operate at a frequency which does not interfere with other radio transmission devices such as cellular telephones or walkie-talkies.

The remote control 156 may be utilized to operate or activate the drive mechanism 114 (i.e., electric motor 116) in order to maintain level or horizontal orientation of the beam assembly 82. In a preferable embodiment, the hoist system 10 may include three (3) remote controls 156 which are provided to various personnel on the ground, personnel on the building at the elevation level, and for other personnel for use as appropriate.

The electric motor 116 is configured to be operated in an automatic mode wherein the electric motor 116 is responsive to signals received from the sensors 136 (i.e., forward an aft micro-switches 138) or autonomous response. However, manual operation is a more preferable mode for regulating the drive mechanism 114 and allows for manual control of the electric motor 116 in order to maintain the level or horizontal orientation of the beam assembly 82 such as in response to activation signals transmitted by the remote control 156 and received by the receiver. Manual operation is believed to result in a faster response time to leveling requirements of the beam assembly 82 during hoisting, maneuvering and offloading of each panel 24 in a sequential manner. In addition, manual operation may provide an additional safety feature to prevent or reduce the risk of injury to personnel as a result of movement of the beam assembly 82 while equipment or body parts may be caught or trapped adjacent the beam assembly 82 and a hard object.

Referring briefly to FIGS. 7 and 8, shown disposed on opposing lateral sides of the beam assembly 82 may be a pair of reel spools 158 which are each configured to allow for an extendable power chord feature for providing 110V power to the electric motor 116 and/or battery charger 148. In one embodiment, at least one of the power chords is preferably connected to appropriate circuitry of the beam assembly 82 in order to provide power thereto. A second one of the power chords is preferably connected to a controller 160 or switch in order to allow switching of the beam assembly 82 from a manual operation mode to an automatic operation mode, or vice versa.

With reference now to FIGS. 1-9, operation of the hoist system 10 will now be described. The panel delivery vehicle 48 (i.e., flatbed tractor trailer) delivers or transports at least one (1) panel set 22 from a panel fabricator at an offsite location to the jobsite where the building structure is located. Each of the panel sets 22 is preferably mounted on a rigid pallet 54 in order to provide stiffness and rigidity to the panels 24 during hoisting and maneuvering thereof. As can be seen in FIG. 3, a panel mover 68 such as a forklift is operative to move each of the panel sets 22 from the panel delivery vehicle 48 to the riser fixture 50 which, as shown in FIG. 4, is mounted on a trailer 52 preferably including outriggers 60 for stability.

Referring to FIG. 5, after offloading of the panel sets 22 from the flatbed trailer onto the riser fixture 50, webbing 66 is passed over the panel set 22 in order to secure the panel set 22 to the riser fixture 50. Referring to FIG. 6, the panel set 22 may then be reoriented from the shipping orientation (i.e., horizontal position) to a hoisting orientation (i.e., near vertical position) such as by using a hydraulic cylinder 62 or other actuation mechanism to rotate the riser fixture 50 about a pivot point 58 on the trailer 52. As shown, the hoist beam 84, which has been suspended above the riser fixture 50 via a lifting mechanism 72 (i.e., tower crane or building crane) is positioned above the panel set 22 such that the panel lugs 40 mounted on each of the panels 24 may be connected to a corresponding one of the trolleys 122. Tag lines 92 on opposing ends of the hoist beam 84 may be used to steady and rotate the hoist beam 84 into position. The connecting cable between each trolley 122 and the corresponding panel 24 may be manually performed with access provided to a top of the near vertically-positioned panels 24 by means of a ladder 64 extending from the riser fixture 50 trailer 52 to the panel set 22.

After each panel 24 is connected by means of a cable to a corresponding trolley 122 of the beam assembly 82, the lifting lug 96 is preferably positioned along the hoist beam 84 length such that when the lifting mechanism 72 hoists upwardly along the beam assembly 82, the hoist beam 84 is maintained in a substantially horizontal or level orientation up to the desired location or elevation level of the building structure. Once hoisted to the desired elevation, each of the panels 24 is offloaded in one-at-a-time fashion during which the lifting lug 96 is repositioned by means of the drive mechanism 114 to compensate for the reduced weight on the end of the hoist beam 84. As was earlier mentioned, the hoist system 10 may include the leveling mechanism 128 which is operative to sense the orientation of the hoist beam 84 and cause the drive mechanism 114 to reposition the lifting lug 96 along the length of the beam by activating the electric motor 116 which, in turn, rotatingly drives the screw drive 118.

Using the hoist system 10 as described above and illustrated in the Figures, considerable time savings can be realized versus an arrangement wherein one panel 24 is hoisted from ground level to the desired elevation. In this regard, the hoist system 10 of the present invention allows for substantial reduction in the overall time to install a plurality of exterior panels 24 or other materials on a building structure. It should further be noted that the hoist system 10 as described herein is not solely limited to installation of exterior cladding panels 24 but may be employed for lifting or hoisting a variety of materials to a desired elevation and allowing sequential offloading from the beam assembly 82 while maintaining a substantially horizontal or level orientation during each offloading sequence.

The above description is given by way of example, and not limitation. Given the above disclosure, one skilled in the art could devise variations that are within the scope and spirit of the invention disclosed herein, including various ways of transporting the panel sets 22 to the jobsite and various ways of re-orienting the panel set 22 into the hoisting orientation. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A hoist system for installing a plurality of panels of a panel set onto a structure at a jobsite, the hoist system comprising:

a panel delivery vehicle for transporting at least one panel set to the jobsite;

a riser fixture for reorienting the panel set from a shipping orientation into a hoisting orientation;

a panel mover operative to move the panel set from the panel delivery vehicle to the riser fixture;

a beam assembly configured to hoist the panels and sequentially offload the panels from the beam assembly onto the structure, the beam assembly including:

an elongate hoist beam;

a lifting lug operatively coupled to the hoist beam and configured to be selectively positionable along a length thereof;

a plurality of trolleys fixedly mounted at one of opposing ends of the hoist beam, each trolley being configured to have at least one panel suspended therefrom; and a drive mechanism operative to reposition the lifting lug along the hoist beam such that the hoist beam is maintained in a substantially horizontal orientation; and a lifting mechanism configured to be coupled to the lifting lug and being adapted to hoist and position the beam assembly relative to the structure.

2. The hoist system of claim 1 wherein the drive mechanism is configured to be manually activatable.

3. The hoist system of claim 2 further including:

a remote control; and a receiver mounted on the hoist beam and being operative to receive signals transmitted by the remote control for regulation of the drive mechanism.

4. The hoist system of claim 1 wherein the drive mechanism is configured to be autonomously activatable.

5. The hoist system of claim 4 further including:

a leveling mechanism operative to sense the orientation of the hoist beam and cause the drive mechanism to reposition the lifting lug along the length of the hoist beam such that the hoist beam is maintained in a substantially horizontal orientation.

6. The hoist system of claim 5 wherein the leveling mechanism comprises:

at least one sensor adapted to sense the orientation of the hoist beam and transmit signals representative thereof to the drive mechanism cause the drive mechanism to reposition the lifting lug along the length of the hoist beam.

7. The hoist system of claim 6 wherein the sensor comprises a pair of micro-switches activatable by a Mercury (Hg) element.

8. The hoist system of claim 5 wherein the drive mechanism comprises:

a screw drive threadably engageable to the lifting lug; and an electric motor coupled to the screw drive and being rotatably responsive to the leveling mechanism.

9. The hoist system of claim 8 further including:

a generator mounted on the hoist beam; and at least one battery adapted to power the electric motor.

10. The hoist system of claim 1 wherein:

the hoist beam is configured as an I-beam having upper and lower flanges interconnected by a vertical web;

the lifting lug having a plurality of rollers engaged to at least one of upper and lower sides of the upper flange for supporting the hoist beam.

* * * * *